US008532514B2

(12) United States Patent
Shida

(10) Patent No.: US 8,532,514 B2
(45) Date of Patent: Sep. 10, 2013

(54) IMAGE FORMING APPARATUS

(75) Inventor: Masanori Shida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 273 days.

(21) Appl. No.: 12/857,726

(22) Filed: Aug. 17, 2010

(65) Prior Publication Data

US 2011/0044710 A1 Feb. 24, 2011

(30) Foreign Application Priority Data

Aug. 18, 2009 (JP) ..... 2009-189053

(51) Int. Cl.
*G03G 15/16* (2006.01)

(52) U.S. Cl.
USPC ..... 399/66

(58) Field of Classification Search
USPC ..... 399/66, 297
See application file for complete search history.

(56) References Cited

U.S. PATENT DOCUMENTS 6,266,495 B1 * 7/2001 Yuminamochi et al. ..... 399/66
7,865,097 B2 1/2011 Ishikawa

FOREIGN PATENT DOCUMENTS

JP 5-6112 A 1/1993
JP 5-80897 A 4/1993
JP 10-207262 A 8/1998
JP 2004-117920 A 4/2004
JP 2008-275844 A 11/2008

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

An image forming apparatus includes an image bearing member; a transfer member for transferring a toner image from the image bearing member onto a transfer material at a transfer portion; a control portion for controlling a voltage to be applied to the transfer member; a current detecting portion for detecting a value of a current passing through the transfer portion; a calculating portion for calculating a relationship between values of the voltage and the current obtained by applying voltages of different values at different intervals between adjacent images during execution of a continuous image forming mode in which the images are continuously formed on recording materials; a determining portion for determining the voltage value for a target current from the calculated relationship; and a switching portion for switching the voltage value to the voltage value determined by the determining portion during the execution of the continuous image forming mode.

7 Claims, 7 Drawing Sheets

IMAGE FORMING APPARATUS

FIELD OF THE INVENTION AND RELATED ART

The present invention relates to an image forming apparatus of an electrostatic recording type such as a printer or a copying machine and specifically relates to the image forming apparatus of the type in which a toner image is transferred from an image bearing member such as a photosensitive drum or the like onto another image bearing member such as a recording material or an intermediary transfer member.

A conventional image forming apparatus such as an electrophotographic copying machine, laser beam printer (LBP), or the like includes a photosensitive drum 1 (image bearing member or electrophotographic photosensitive member), a charger 2, an exposure device 3, a developing device, and the like. In the case where image formation is effected, after the surface of the photosensitive drum 1 is electrically charged by the charger 2, an electrostatic latent image is formed on the photosensitive drum 1 by the exposure device 3. Then, by the developing device 4 containing a developer including a magnetic carrier and toner in mixture, the electrostatic latent image on the photosensitive drum 1 is developed into the toner image. The toner image is electrostatically transferred from the photosensitive drum 1 onto a belt-like intermediary transfer belt 5 (another image bearing member or intermediary transfer member) disposed opposed to the photosensitive drum 1 (primary transfer). Further, the toner image is electrostatically transferred from the intermediary transfer belt 5 onto a recording material P (secondary transfer). Such primary transfer and secondary transfer are performed by applying voltages from power sources 6*a* and 6*b* to transfer portions (primary transfer portion T1 and secondary transfer portion T2). For this purpose, the power sources 6*a* and 6*b* are connected with transfer rollers 7*a* and 7*b* (transfer members) disposed at the transfer portions. As a type of a transfer means used for such primary transfer and secondary transfer, in recent years, a roller type is generally used but it is also possible to use a blade type.

The transfer relationships 7*a* and 7*b* are adjusted to have a resistance value of about $1\times10^{6}$-$1\times10^{10}$ ohm. However, in recent years, as shown in FIG. 10, a structure in which an elastic layer 9 is formed on an outer circumferential surface of an electroconductive core metal 8 and electroconductivity is imparted to the elastic layer 9 has been proposed.

The transfer rollers 7*a* and 7*b* having the electroconductive layer are liable to vary in resistance depending on a temperature/humidity or an energization time similarly as in the case of the toner. When the resistance variation of the transfer rollers 7*a* and 7*b* occurs, in the case of the constant voltage control, variation in current value is caused and the voltage is deviated from a necessary transfer current value, so that a transfer property is lowered.

As a control method which addresses the resistance variation of the transfer member, there is a transfer voltage adjusting method of a programmable transfer voltage control (PTVC) type. In the case of this type, before a printing operation, a voltage to be applied to the transfer portion which has been subjected to the constant voltage control is changed stepwisely and at the same time, a value of a current passing through the transfer portion is monitored. From a resistance between the current and the voltage at this time, a voltage value for a target current is derived. Then, the derived voltage is used as a transfer voltage during the image formation (hereinafter, this method is referred to a "transfer voltage adjusting method by constant voltage control"; Japanese Laid-Open Patent Application (JP-A) Hei 5-6112).

In such a constitution, there is a need to apply a plurality of voltages of different voltage values, so that it takes a time.

When the above-described control is effected at intervals between adjacent recording materials during execution of a continuous image forming mode in which images are continuously formed on the recording materials, a downtime is increased and thus productivity is lowered.

On the other hand, as a constitution for simply modifying the transfer current at the intervals between adjacent recording materials, a method in which the voltage is successively increased at a sheet interval which is a non-sheet-passing period in which the recording material does not pass through a gap between the image bearing member and the transfer member, and then the detected current value at this time and a target current value are compared with each other to correct a transfer voltage has also been proposed (JP-A Hei 10-207262). Incidentally, examples of the resistance variation of the transfer roller during the continuous printing may include a resistance lowering due to temperature rise as a short-term variation and a resistance increase due to transfer roller deterioration by energization as a long-term variation.

Thus, when the transfer voltage is calculated with high accuracy in the constitution in which the resistance of the transfer roller varies, there is a need to calculate a plurality of voltage values and current values in a state in which the resistance of the transfer roller is changed.

This will be described with reference to FIG. 11. FIG. 11 shows a relationship between the current and the voltage at the transfer portion in an initial state and a relationship between the current and the voltage in the case where the resistance of the transfer roller is increased by the influence of the energization deterioration during the continuous printing. First, it is assumed that a transfer voltage TrV1 corresponding to a target current TrI1 has been applied during the image formation by the transfer voltage adjusting method by constant voltage control before the image formation (in the initial state). Thereafter, it is assumed that the relationship between the current and the voltage is changed and thus the current at the time of applying the transfer voltage TrV1 is lowered to a current TrI2. At this time, in the case where the voltage value is corrected from the initial relationship between the current and the voltage (i.e., a current-voltage (I-V) curve in the figure), the correction is made in the following manner. That is, a difference between the transfer voltage TrV1 corresponding to the initial target current TrI1 and the transfer voltage TrV2 corresponding to the current TrI2 which has been lowered by the increase in resistance of the transfer roller during the continuous printing, i.e., TrV1−TrV2=ΔV1 is added to the transfer voltage TrV1, thus making the correction.

However, even when the transfer voltage is corrected as described above, as shown in FIG. 11, the I-V curve in the initial state and the I-V curve during the continuous printing are changed from each other. For this reason, even when the difference ΔV1 is added to the transfer voltage TrV1, the current in the I-V curve during the continuous printing is TrI3. Therefore, even when the above-described correction is mode, the current value TrI3 is smaller than the target current value TrI1. Such a shortage in current becomes a factor which causes a larger error with a larger resistance variation. For that reason, even in a constitution in which the interval adjacent recording materials is small, a constitution for calculating the transfer voltage with high accuracy has been desired.

SUMMARY OF THE INVENTION

A principal object of the present invention is to provide an image forming apparatus capable of calculating a transfer voltage with high accuracy even when an interval between adjacent recording materials varies.

According to an aspect of the present invention, there is provided an image forming apparatus comprising:

an image bearing member;

a transfer member for transferring a toner image from the image bearing member onto a transfer material at a transfer portion;

a control portion for controlling a voltage to be applied to the transfer member;

a current detecting portion for detecting a value of a current passing through the transfer portion;

a calculating portion for calculating a relationship between values of the voltage and the current which are obtained by applying voltages of different values at different intervals between adjacent images during execution of a continuous image forming mode in which the images are continuously formed on recording materials;

a determining portion for determining the voltage value for a target current from the relationship calculated by the calculating portion; and a switching portion for switching the voltage value to the voltage value determined by the determining portion during the execution of the continuous image forming mode.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

Figure 1:
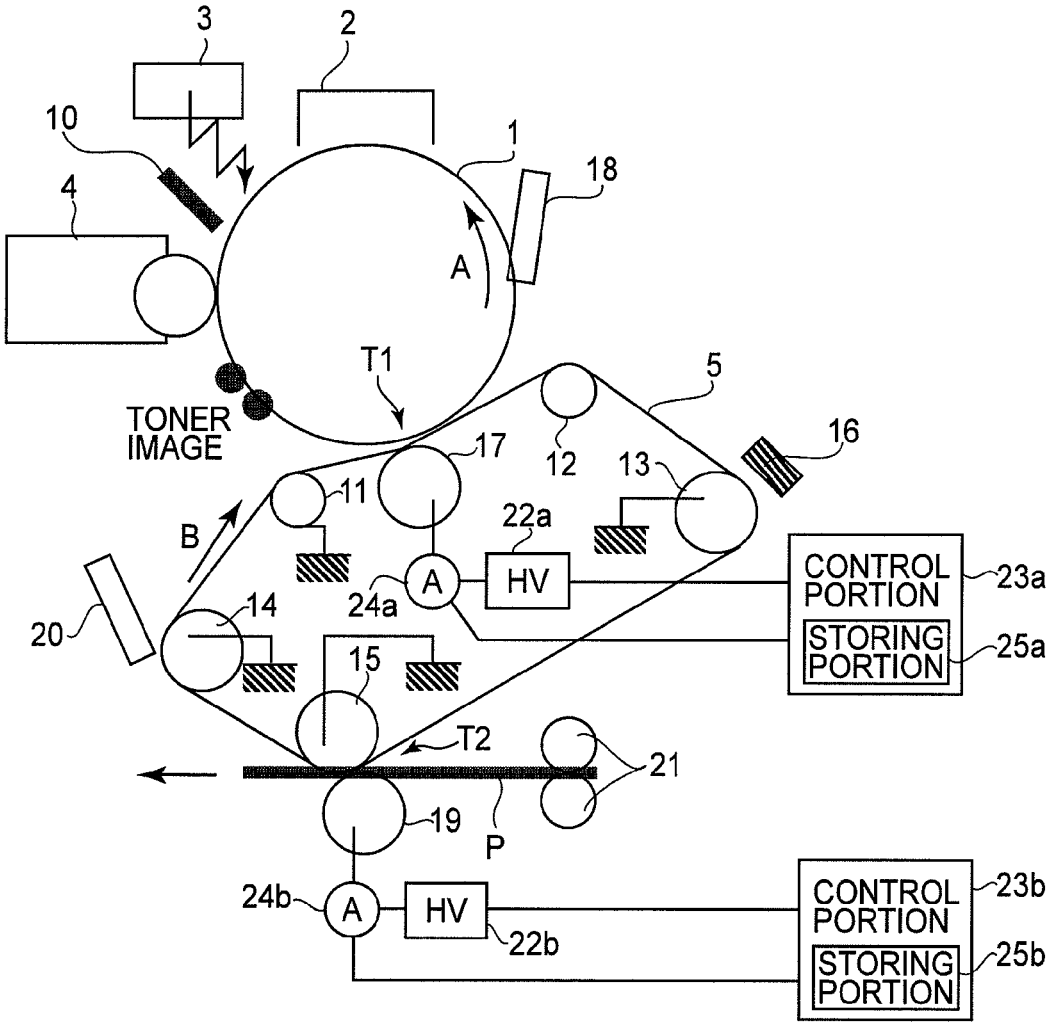
FIG. 1 is a schematic view according to First Embodiment of the present invention.
Figure 9:
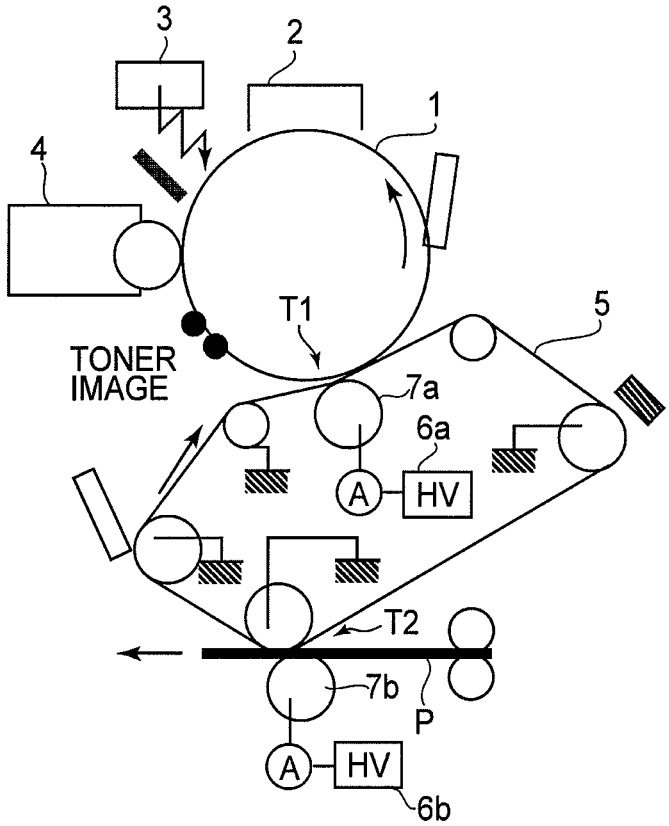
FIG. 9 is a schematic view showing an example of a conventional structure of the image forming apparatus.

First Embodiment of the present invention will be described with reference to FIGS. 1 to 5. FIG. 1 shows a schematic structure of the image forming apparatus according to the present invention. In FIG. 1, a basic structure is substantially similar to the conventional structure described with reference to FIG. 9. For this reason, the description of equivalent portions will be omitted or simplified and portions which are not described with reference to FIG. 9 will be principally described. On the surface of the photosensitive drum 1 (image bearing member), by the rotation of the photosensitive drum 1 in a direction indicated by an arrow A, an electrostatic latent image corresponding to image information is formed through a known electrophotographic process including charging by the charger 2, exposure by the exposure device 3 on the basis of the image information, and the like. Then, the electrostatic latent image formed on the photosensitive drum 1 is developed by the developing device 4, so that the toner image is formed on the photosensitive drum 1. Incidentally, a reference numeral 10 represents a potential detecting means for detecting a surface potential of the photosensitive drum 1. Further, although omitted from illustration, a drum heater is provided in the photosensitive drum 1 so as to keep a temperature in the neighborhood of the surface of the photosensitive drum 1 at a constant level in some cases. As a result, an amount of ambient water content in the neighborhood of the surface of the photosensitive drum 1 is adjusted, so that the above-described formation of the electrostatic latent image can be stably effected.

Further, the intermediary transfer belt 5, which is another image bearing member, disposed in contact with the surface of the photosensitive drum 1 is rotationally driven in a direction indicated by an arrow B while being stretched around a plurality of stretching rollers 11 to 15. In this embodiment, the stretching rollers 11 and 12 are disposed in the neighborhood of the primary transfer portion T1 and are metal-made follower rollers used for creating a flat primary transfer surface of the intermediary transfer belt 5. Further, the stretching roller 13 is a tension roller for controlling the tension of the intermediary transfer belt 5 at a constant level. Further, the stretching roller 14 is a driven roller of the intermediary transfer belt 5. Further, the stretching roller 15 is an opposite roller for the secondary transfer. Incidentally, a reference numeral 16 represents a density detecting means for detecting the density of the toner image on the intermediary transfer belt 5.

As a material for the above-described intermediary transfer belt 5, it is possible to use various resin materials such as polyimide, polycarbonate, polyester, polypropylene, polyethylene terephthalate, acrylic resin, vinyl chloride resin; various rubber materials; and the like. Further, it is also possible to use a material prepared by adding carbon black as an antistatic agent into these various resin materials or various rubber materials in an appropriate amount so as to have a volume resistivity of $1\times10^{8}$-$1\times10^{13}$ (ohm·cm). The thickness of the intermediary transfer belt 5 is 0.07-0.1 (mm).

Figure 10:
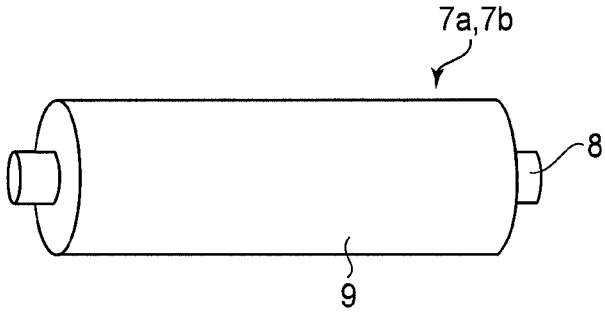
FIG. 10 is a schematic perspective view showing a transfer roller.
Figure 11:
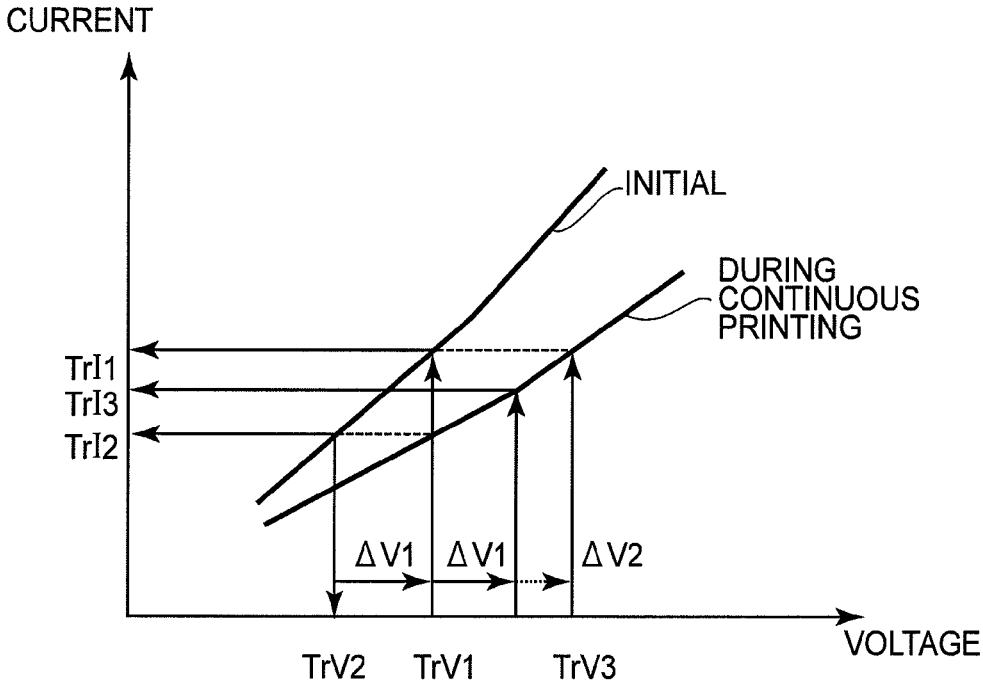
FIG. 11 is a graph showing relationships between the current and the voltage in the initial state and during continuous printing in order to illustrate transfer voltage control which would be considered in the conventional structure.

Further, at the primary transfer portion T1 where the intermediary transfer belt 5 opposes the photosensitive drum 1, a primary transfer roller 17 as a transfer means is disposed on a side (inside the intermediary transfer belt 5) where the intermediary transfer belt 5 is located between the photosensitive drum 1 and the roller 17. By applying a primary transfer bias of a positive polarity opposite to a charge polarity of the toner to the primary transfer roller 17, the toner image is primary-transferred from the photosensitive drum 1 onto the intermediary transfer belt 5. The toner remaining on the photosensitive drum 1 after the primary transfer is removed by a drum cleaner 18. Incidentally, the above-described primary transfer roller 17 and the secondary transfer roller 19 described later may also be configured to have the structure as described with reference to FIG. 10.

Further, the secondary transfer portion T2 of the intermediary transfer belt 5 facing a conveyance path of the recording material P as another image bearing member is constituted by the secondary transfer roller 19 and the stretching roller 15. Of these rollers, the secondary transfer roller 19 is disposed on a toner image carrying surface side of the intermediary transfer belt 5 (outside the intermediary transfer belt 5). Further, the stretching roller 15 is disposed inside the intermediary transfer belt 5 so as to oppose the secondary transfer roller 19. Further, the secondary transfer roller 19 is disposed so as to be shifted toward an upstream side with respect to a conveyance direction of the recording material P. The stretching roller 15 is grounded and constitutes an opposite electrode for the secondary transfer roller 19. To the secondary transfer roller 19, a secondary transfer bias of an opposite polarity to the charge polarity of the toner is applied.

Further, on a downstream side of the secondary portion T2, a belt cleaner 20 for removing the toner remaining on the intermediary transfer belt 5 after the secondary transfer is provided. Incidentally, the secondary transfer roller 19 and the belt cleaner 20 are provided so as to be movable toward and away from the intermediary transfer belt 5. Further, in the case where color images of a plurality of colors are formed, the secondary transfer roller 19 and the belt cleaner 20 are spaced from the intermediary transfer belt 5 until the toner image of the color before the final color passes through the secondary transfer roller 19 and the belt cleaner 20.

Further, the recording material P is sent from an unshown conveying path and is, after being once positioned and stopped, sent to the secondary transfer portion T2 with predetermined timing. After the toner image is transferred from the intermediary transfer belt 5 onto the recording material P, the recording material P is conveyed into an unshown fixing device disposed downstream of the secondary transfer portion T2 by an unshown conveying means, in which the toner images melt-fixed on the recording material P. The recording material P on which the toner image is fixed is discharged on an unshown sheet discharge tray by an unshown sheet discharging means or in the case where both-side printing is effected, is sent to the image forming portion again through an unshown reverse conveying means.

In this embodiment, in the case where the continuous printing is effected by the image forming apparatus having the above-described constitution, the following constitution is employed in order to property control the transfer voltage. First, the image forming apparatus includes power sources (high-voltage power sources HV) 22*a* and 22*b* for applying voltages to the primary transfer roller 17 and the secondary transfer roller 19 which are the transfer means. Further, the image forming apparatus includes control portions 23*a* and 23*b* for controlling the voltages of the respective power sources 22*a* and 22*b* and includes current detecting portions 24*a* and 24*b* for detecting voltages of currents which pass through the primary transfer portion T1 and the secondary transfer portion T2. Of these portions, the control portions 23*a* and 23*b* may be provided correspondingly to the power sources 22*a* and 22*b*, respectively, and may also be provided in a single CPU such as a CPU for controlling the entire image forming apparatus.

These control portions 23*a* and 23*b* control the power sources 22*a* and 22*b* so that voltages which are different every interval between adjacent images consecutively transferred a predetermined number of times onto the intermediary transfer belt 5 or the recording material P are applied to the primary transfer roller 17 and the secondary transfer roller 19. That is, at the primary transfer portion T1, in the case where the continuous printing is effected, the control portion 23*a* controls the power source 22*a* so that a different voltage is applied at every interval (between adjacent images) from after the toner image is transferred from the photosensitive drum 1 onto the intermediary transfer belt 5 until a subsequent toner image is transferred. On the other hand, at the secondary transfer portion T2, in the case where the continuous printing is effected, the control portion 23*b* controls the power source 22*a* so that a different voltage is applied at every interval (sheet interval) from after the toner image is transferred from the intermediary transfer belt 5 onto the recording material P until a subsequent toner image is transferred. Such application of the different voltages is repeated the predetermined number of times (e.g., 5 times) as a set. In this case, the voltages applied as the set may also be different from those applied as a subsequent set. Incidentally, each voltage to be applied to the secondary transfer roller 19 has a voltage value obtained by subtracting a shared (allotted) voltage of the recording material P from a voltage for normal secondary transfer. This is because the recording material P is not present at the primary transfer portion T1 but is present at the secondary transfer portion T2 and therefore the shared voltage is required to be taken into consideration.

For each of the voltages applied to the intervals between adjacent toner images, a value of a current passing through the primary transfer portion T1 or the secondary transfer primary T2 is detected by the current detecting portion 24*a* or 24*b*. The current values detected by these current detecting portions 24*a* and 24*b* are stored together with voltage values at that time in storing portions 25*a* and 25*b* provided in the control portions 23*a* and 23*b* or provided in a memory in the CPU of the image forming apparatus. Data stored in these storing portions 25*a* and 25*b* are updated in the case where a voltage changing range is ended (i.e., the application of the set of voltages is completed) or the case where the voltage applied at the time of transferring the toner image is switched.

When the toner image is transferred onto the intermediary transfer belt 5 or the recording material P, the control portions 23*a* and 23*b* select voltages from those applied at the intervals between adjacent images or the sheet intervals as described above so that the current values detected by the current detecting portions 24*a* and 24*b* are closest to a target current value. This voltage selection may be performed separately for the primary transfer portion T1 and the secondary transfer portion T2 or performed so as to select the same value for the primary and secondary transfer portions T1 and T2. That is, the primary transfer roller 17 and the secondary transfer roller 19 are separate members and are disposed at different places, so that changes in resistance thereof do not always coincide with each other. For, this reason, the voltages for the primary and secondary transfer portions T1 and T2 may preferably be separately selected. On the other hand, in the case where the difference of the changes in resistance of the primary and secondary transfer rollers 17 and 19 is no so large or in the case where there is a predetermined relationship between these changes in resistance, the current detection and the voltage selection may be performed only at either one of the transfer portions, and at the other transfer portion, the same value or a value obtained by multiplying the value by a predetermined coefficient. As a result, the number of parts can be reduced and thus cost reduction can be realized. In either case, where the toner image is transferred, the control portions 23*a* and 23*b* control the power sources 22*a* and 22*b* so that the voltages selected for the respective transfer portions or the same value or the voltage obtained by multiplying the value by the predetermined coefficient is applied or so that the voltage to which the shared voltage of the recording material P is added is applied to the secondary transfer roller 19.

Figure 2:
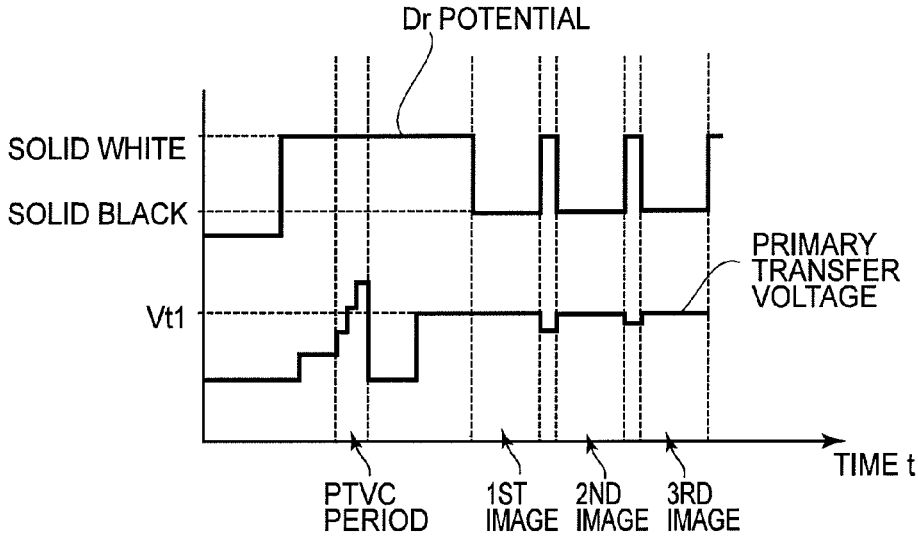
FIG. 2 is a time chart for illustrating transfer voltage control including control before image formation in First Embodiment.

The above-described control will be described more specifically. Incidentally, the control at the primary transfer portion T1 and the control at the secondary transfer portion T2 are basically the same except that the shared voltage of the recording material P is taken into consideration at the secondary transfer portion T2 and therefore in the following description, the control at the primary transfer portion T1 will be explained. FIG. 2 is a time chart for illustrating the transfer voltage adjusting method by constant voltage control for adjusting the transfer voltage (bias) to be applied to the primary transfer roller 17 in a period from formation of a first image (toner image) before image formation. In FIG. 2, progression of a surface potential of the photosensitive drum 1 (Dr potential progression) and progression of the voltage applied to the primary transfer roller 17 (primary transfer voltage progression) are shown in parallel. That is, an upper solid line represents the Dr potential progression and a lower solid line represents the primary transfer voltage progression. Further, in this embodiment, a solid black image with a duty ratio of 100% is continuously printed (formed), so that an image portion has a solid black potential and a portion between adjacent toner images has a solid white potential. Incidentally, these are also true for FIGS. 3 and 4 described later.

In this embodiment, first, as shown in FIG. 2, after the Dr (photosensitive drum) potential reaches the solid white potential, the voltage is changed stepwisely in the period of execution of the PTVC, so that a voltage (a target transfer voltage Vt1 in the figure) with respect to a target current (target current value) is calculated. For example, before the image formation at the time when the surface of the photosensitive drum 1 is uniformly charged by the charger 2 and the charged portion reaches the primary transfer portion T1, the voltage is applied from the power source 22*a* to the primary transfer roller 17 while being changed stepwisely. A value of the current passing through the primary transfer portion T1 at this time is detected for each of the changed voltage calculates by the current detecting portion 24*a*. Then, a relationship detect the current and the voltage at the primary transfer portion T1 in an initial state is derived and from this relationship, a voltage value (target voltage Vt1) corresponding to the target current value is obtained.

Figure 3:
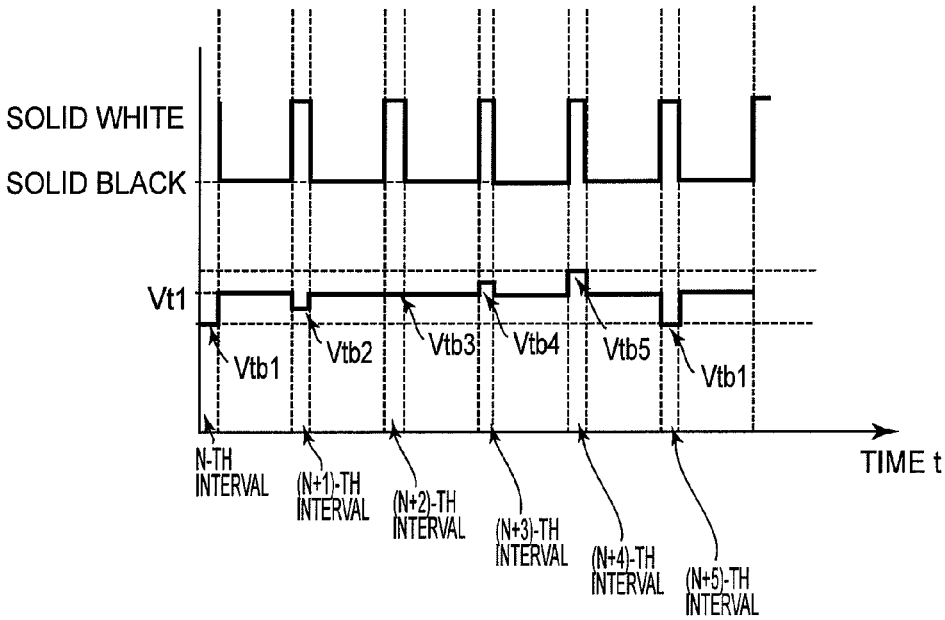
FIG. 3 is a time chart for illustrating control during continuous printing.

FIG. 3 is a time chart for illustrating the control at an interval between N-th (toner) image and (N+1)-th (toner) image, i.e., an N-th image interval and the later during the continuous printing. That is, each of "N-TH INTERVAL", "(N+1)-TH INTERVAL", "(N+2)-TH INTERVAL", . . . indicated in FIG. 3 represents the interval between adjacent toner images during the continuous printing. In this case, at the intervals between adjacent images, the voltage applied to the primary transfer roller 17 is changed stepwisely from Vtb1 to Vtb5. That is, the control portion 23*a* controls the power source 22*a* so that the voltage applied to the primary transfer roller 1 is Vtb1 at "N-TH INTERVAL", Vtb2 at "(N+1)-TH INTERVAL", . . . as shown in FIG. 3.

These voltages Vtb1 to Vtb5 are different from each other and are stepwisely increased from Vtb1 to Vtb5 on the basis of a predetermined voltage difference (increment). Further, the voltage difference is determined by estimating the resistance of the primary transfer roller 17 while taking into consideration the content of water contained in the primary transfer roller 17 from an environment such as a temperature or a humidity. For example, in the case where the humidity inside the image forming apparatus is judged as being high by an environment sensor, for measuring the temperature and the humidity, provided in the image forming apparatus, it is considered that the water content in the primary transfer roller 17 is large and therefore it is predicted that the resistance of the primary transfer roller 17 is low. In this case, the value of the current passing through the primary transfer roller is largely changed when the voltage difference is changed largely, so that there is a possibility that the current value is considerably deviated from the target current value. Therefore, the voltage difference among Vtb1 to Vtb5 is made small. On the other hand, when the water content in the primary transfer roller 17 is small and the resistance of the primary transfer roller 17 is high, the change in value of the current passing through the primary transfer roller 17 in the case where the voltage difference is changed small, so that it is considered that the voltage difference is less liable to meet the change in target current. Therefore, the voltage difference among Vtb1 to Vtb5 is made large. For this reason, in this embodiment, a table with respect to a plurality of voltage differences depending on the temperature/humidity environment is employed.

Further, in this embodiment, of the voltage values Vtb1 to Vtb5, the voltage value Vtb3 is made equal to the target voltage Vt1 determined in the initial state as the voltage to be applied when the toner image is transferred. The values of currents passing through the primary transfer portion T1 when the stepwisely changed voltages Vth1 to Vth5 are applied are detected by the current detecting portion 24*a*. Then, the voltage values and the current values are stored in the storing portions.

Figure 4:
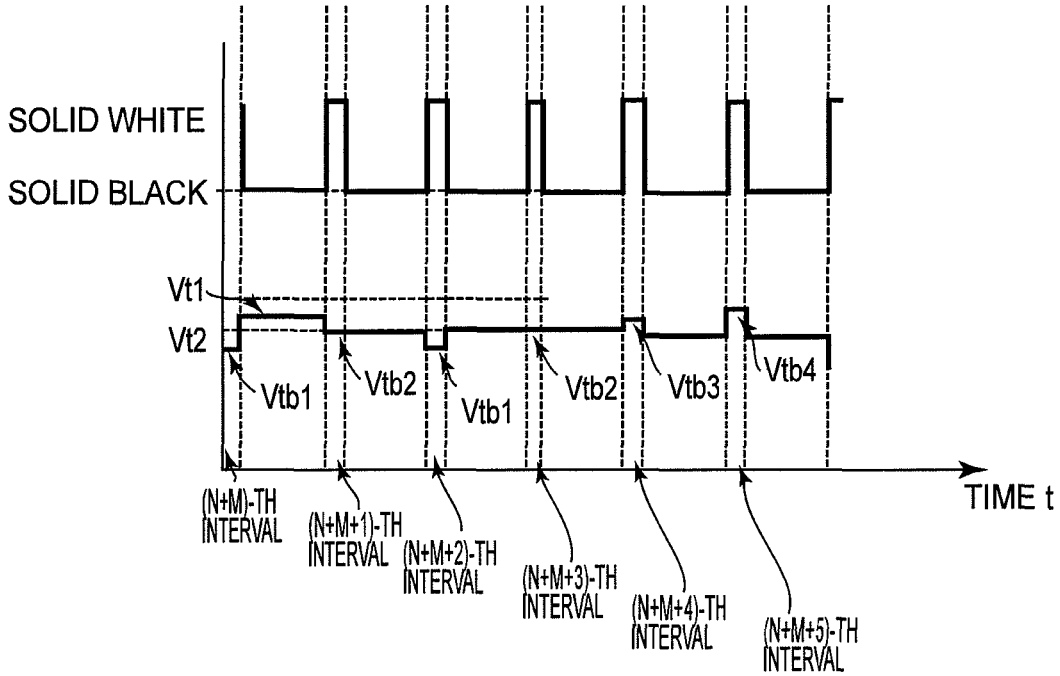
FIG. 4 is a time chart for illustrating control at an (N+M)-th interval between adjacent images or later.
Figure 5:
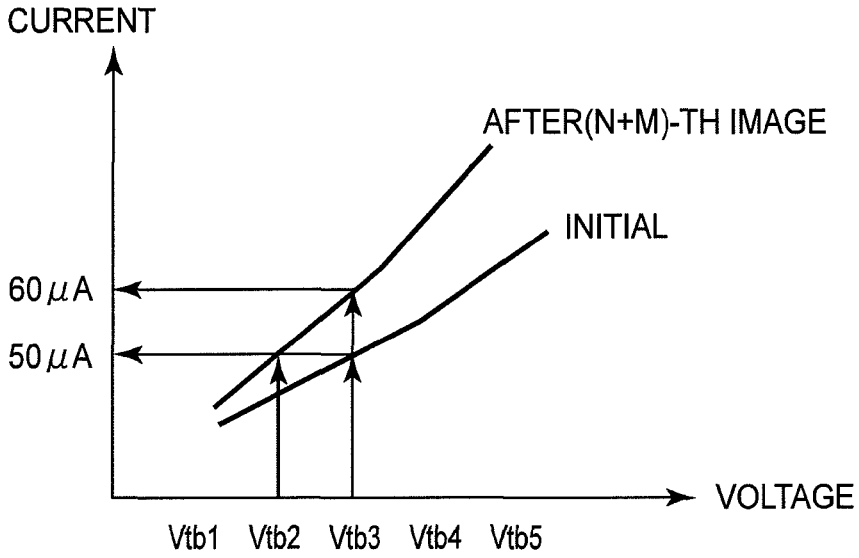
FIG. 5 is a graph showing relationships between a current and a voltage (I-V curve) in an initial state and after formation of an (N+M)-th image in First Embodiment.

FIG. 4 is a time chart for illustrating the control at an interval between an (N+M)-th image and an (N+M+1)-th image, i.e., an (N+M) image interval and the later in periods in which the continuous printing proceeds. In this stage, the resistance of the primary transfer roller 11 is lowered and in the case where the target voltage Vt1 (=Vtb3) is applied, the value of the current passing through the primary transfer portion T1 is larger than the target current value. This will be described with reference to FIG. 5. In the case where the continuous printing proceeds and the resistance of the primary transfer roller 17 is lowered due to a short-term temperature rise in the image forming apparatus and the temperature rise of the primary transfer roller 17 itself, as shown in FIG. 5, the relationship between the current and the voltage in the initial state and that after formation of the (N+M)-th image are different from each other. Specifically, the current value at the time when the voltage applied to the image interval portion and the image portion is subjected to the constant voltage control at Vtb3 is increased. In this embodiment, as shown in FIG. 5, when the target current value is 50 μmA as a provisional value, the current of 50 μA at Vtb3 flows in an I-V (current-voltage) curve in the initial state but the current value is increased to 60 μA in the I-V curve after formation of the (N+M)-th image due to the lowering in resistance of the primary transfer roller 17.

In this case, in the I-V curve after formation of the (N+M)-th image, the current flowing when the voltage Vtb2 of the stepwisely changed voltages Vtb1 to Vtb5 at the image intervals is applied is 50 μA. Therefore, the voltage Vtb2 providing the current value closest to (in this embodiment, equal to) the target current value is selected from the voltages Vtb1 to Vtb5 and is applied at the (N+M+1)-th image interval, in which the voltage Vtb2 is applied in the control shown in FIG. 4, and the later. That is, the control portion 23*a* controls the power source 22*a* so that the voltage Vtb2 is applied when the toner image is transferred at the (N+M+1)-th image interval and the later. In other words, the transfer voltage of the toner image at the (N+M+1)-th image interval and the later is shifted from Vtb3 (Vt1) to Vtb2 (Vt2). Thus, at these image intervals, the target voltage is Vtb2.

At the (N+M+2)-th image interval and the later after the target voltage is shifted, the voltages Vtb1 to Vtb5 are applied in the same manner as in the case of the target voltage Vtb3. Then, when the current value at the time of applying the transfer voltage Vtb2 is deviated from the target current value of 50 μA, the voltage is shifted to that corresponding to the current value which is selected from those at the time of applying, e.g., the voltages Vtb1 and Vtb3 and which is closest to 50 μA.

Incidentally, the voltage applied at each of the intervals between adjacent toner images may preferably contain the value of the voltage applied when the toner image is transferred. In the above-described case, the voltage contains Vtb3 in a first stage and contains Vtb2 in a subsequent stage. This is also similarly applied to the case where the value of the current flowing when the voltage Vtb2 is applied does not coincide with the target current value but is closest to the target current value. That is, in this embodiment, the plurality of voltages is applied, and from these voltages, the voltage providing the current value closest to the target current value is selected. Therefore, even in the case where the selected voltage is applied, the resultant current value does not coincide with the target current value in some instances. However, when the continuous printing proceeds, it is considered that the value of the current flowing when the voltage is applied approaches the target current value. Further, it is also considered that the voltage with respect to the target current value once tends to be apart from the voltage but approaches the target current value again depending on the change in environment. Therefore, when the plurality of voltages is applied at the intervals between adjacent images in the subsequent stage, it is preferable that the voltage contains the voltage applied when the toner image is transferred.

Further, the voltage applied at each of the intervals between adjacent images may be changed a predetermined number of times on the basis of a predetermined voltage difference, and a voltage value changing range may also be updated to a range in which the value of the voltage applied when the toner image is transferred is a center value. In the above-described description, the voltage applied at each of the intervals between adjacent images is changed 5 times and the voltage value changing range contains Vth3 as the center value until the (N+M)-th image interval. Further, also at the (N+M)-th image interval and the later, the voltage value changing range contains Vtb3 as the center value. On the other hand, at the (N+M+1)-th image interval and the later, the value of the voltage (target voltage) applied when the toner image is transferred is Vtb2, so that the voltage value changing range is updated to the range containing Vtb2 as the center value. In this case, the voltage Vtb5 is not applied but a voltage (e.g., Vtb0) which is smaller than Vtb1 is applied. Thus, when the range of the voltage applied at each of the intervals between adjacent images is updated to the range containing the target voltage as the center value, the control is easy to meet the change in target current value due to the change in environment. Further, even in the case where the current value is finally deviated largely from the initial target current value, the target current value can be shifted following the deviated current value.

According to the above-described this embodiment, even when the relationship between the current and the voltage (I-V current value) is changed from that in the initial state, the voltage providing the current value closest to the target current value is selected and applied. For this reason, irrespective of this change in I-V curve, it is possible to make proper transfer voltage correction with respect to the resistance of the primary transfer portion T1 at that time. As a result, even in the case where the resistance of the primary transfer roller 17 is changed due to the change in environment of the inside of the image forming apparatus or the change in temperature of the primary transfer roller 17 itself and this the current value when the constant voltage control is effected is changed, the transfer voltage can be properly shifted thereby to prevent improper transfer. Further, data of the voltage and the current for selecting such a transfer voltage are obtained for each of the intervals between adjacent toner images (each of the image intervals) by applying the different voltages to the primary transfer roller 17, so that the printing is not interrupted for the purpose of performing this operation. As a result, it is possible to prevent a lowering in productivity due to the interruption of the printing.

Incidentally, with respect to the voltage changed stepwisely at each of the image intervals, the voltage difference or the number of steps may also be those other than the above-described values. For example, when the voltage difference is decreased and the number of steps is increased, it is possible to effect further fine control. Further, in the case where a change (circumferential non-uniformity) in current value in one full circumference of the primary transfer roller 17 due to a shape error of the primary transfer roller 17 is taken into consideration, in order to average the circumferential non-uniformity, the voltage applied at each of the image intervals may also be held at an arbitrary print number (X sheets). That is, the voltage applied at the respective intervals between adjacent images when the toner image is printed on X sheets is made constant. Further, an average of current values at that time is calculated and taken as the current value at the voltage. In this case, when the above-described fine voltages are applied, the voltage application at (5×X) image intervals is required but control accuracy can be further improved.

In the above description, the constitution in which the transfer voltage applied at the image intervals or the sheet intervals is changed among five points (values) is described but the number of points may only be required to be two or more. For example, it is possible to effect the control when there are two points between which the voltage Vtb3 applied to the primary transfer roller 17 or the secondary transfer roller 19 is present. However, in that case, it is important that the voltage Vtb3 is intervened between the two points of the voltage and therefore voltage setting of the two points becomes important. Further, the plurality of voltages applied at the image intervals or the sheet intervals may also be decreased stepwisely, different from those which are increased stepwisely as described above. Further, these stepwisely changes in voltage are provided on the basis of a predetermined condition but this condition may also be determined so that the voltage converges to a certain voltage value, in addition to those in which the voltage is increased or decreased stepwisely. For example, the voltage value with respect to the target current value obtained in the initial state is taken as a converged value and the voltage may also be applied in such a manner that the voltage value is decreased in amplitude toward the converged value while alternately exceeding and falling below the converged value. In such a constitution, it is possible to shift the voltage to a proper voltage similarly as in the case where the applied voltage is increased or decreased stepwisely. Further, by changing the voltage stepwisely in this way, the control which meets the change in target current value is easy to be effected and it is possible to reduce the timewise influence. On the other hand, e.g., in the case of arbitrarily applying the voltage, it takes a time to obtain the voltage corresponding to the target current value in some cases.

In the above description, the control at the primary transfer portion T1 is described but the control at the secondary transfer portion T2 may also be effected similarly as in the above-described case. However, in the case of the control at the secondary transfer portion T2, there is a need to take the resistance of the recording material P into consideration as described above. That is, at the secondary transfer portion T2, when the toner image is transferred from the intermediary transfer belt 5 onto the recording material P, the voltage is applied. For this reason, the voltage applied to the secondary transfer roller 19 is required to be made larger than that in the state in which the recording material P is not present (i.e., at the sheet interval) in consideration of the resistance of the recording material P. At this sheet interval, assuming that a current It passes through the secondary transfer portion T2 when a voltage Vt is applied, in the case where the recording material P is present, the current It does not flow until a voltage (Vt+Vp) is applied in consideration of the resistance of the recording material P. This voltage Vp is the shared voltage of the recording material P.

In this embodiment, when the toner image is transferred onto the recording material P, the voltage (Vt+Vp) is applied, and at the sheet intervals, the voltage Vt which is obtained by subtracting the shared voltage Vp of the recording material P from the voltage (Vt+Vp) is applied. The voltage value Vt varies depending on the change in resistance of the secondary transfer roller 19 and therefore similarly as in the above-described case, the voltage value Vt is changed at each sheet interval and the current value at that time is detected, so that the voltage providing the current value which is closest to the target current value is selected. Further, when the toner image is transferred onto the recording material P, the shared voltage Vp of the recording material P is added to the selected voltage and the resultant voltage is applied. As a result, even in the case where the resistance of the secondary transfer roller 19 is changed due to the change in environment in the image forming apparatus or the change in temperature of the secondary transfer roller 19 itself and thus the current value is changed when the constant voltage control is effected, the transfer voltage can be properly changed and thus improper transfer can be prevented. Further, the lowering in productivity due to the interruption of the printing can also be prevented. Incidentally, the shared voltage Vp of the recording material P also varies depending on the temperature/humidity environment in the image forming apparatus and therefore when the shared voltage Vp is changed depending on the change in environment, a further proper transfer voltage can be applied. Data with respect to this shared voltage Vp are obtained in advance through an experiment or the like and are stored in, e.g., the CPU.

Second Embodiment

Figure 6:
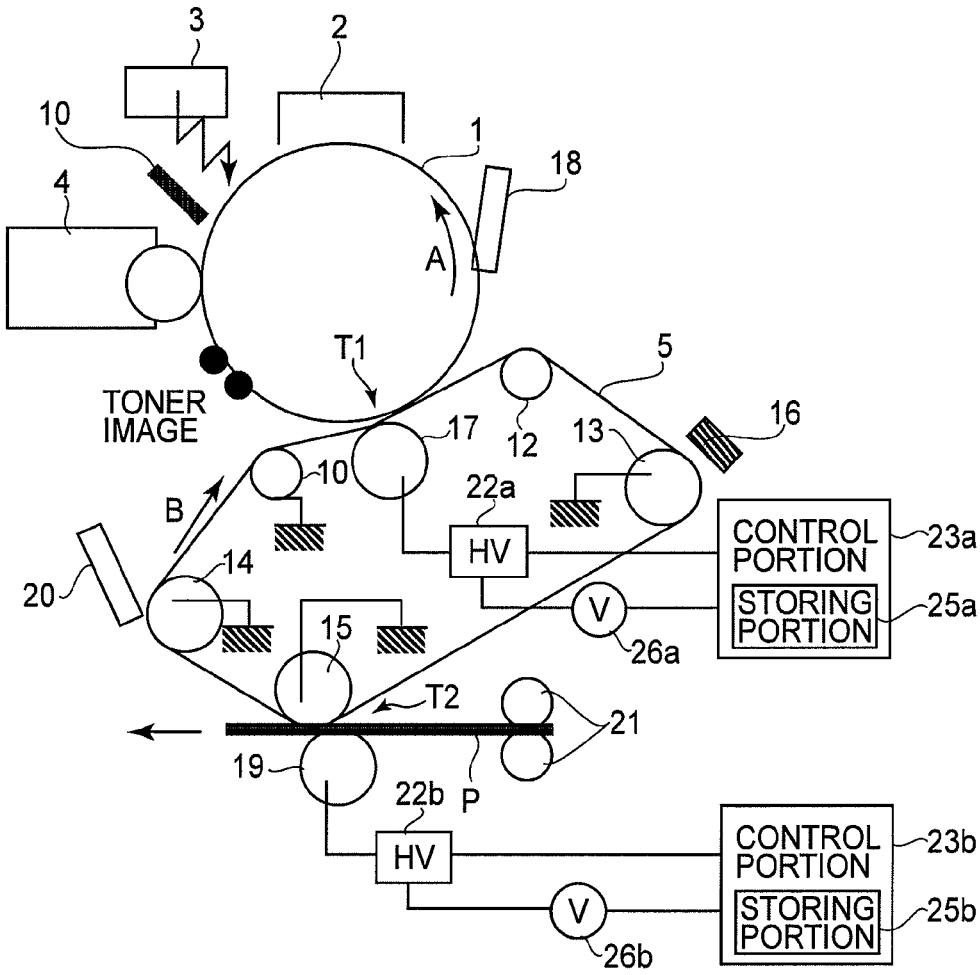
FIG. 6 is a schematic view according to Second Embodiment of the present invention.

Second Embodiment of the present invention will be described with reference to FIG. 6. In First Embodiment, the transfer voltage adjusting method by constant voltage control is described but in this embodiment, the constant voltage control is employed during the image formation and is switched to constant current control only during the transfer voltage adjustment. In this embodiment, during the transfer voltage adjustment, a voltage value monitored by applying a target current which is intended to be applied during the image formation is applied during the image formation. Specifically, the power sources 22*a* and 22*b* are switchable between the constant voltage current and the constant voltage control. The image forming apparatus includes voltage detecting portions 26*a* and 26*b* for detecting the voltage values applied to the primary transfer roller 17 and the secondary transfer roller 19 in the case of effecting the constant current control. The control portions 23*a* and 23*b* control the power sources 22*a* and 22*b* so that the target current is applied at each of the intervals between adjacent toner images (the image intervals or the sheet intervals) by the constant current control. At this time, by the voltage detecting portions 26*a* and 26*b*, voltage values corresponding to the target current values applied at each of the intervals between adjacent toner images are detected. The detected voltage values are stored in the storing portions 25*a* and 25*b*. When the toner image is transferred, the control portions 23*a* and 23*b* control the power sources 22*a* and 22*b* so that the voltage values stored in the storing portions 25*a* and 25*b* are applied by the constant voltage control. Other constitutions and actions are similar to those in First Embodiment.

Third Embodiment

Figure 7:
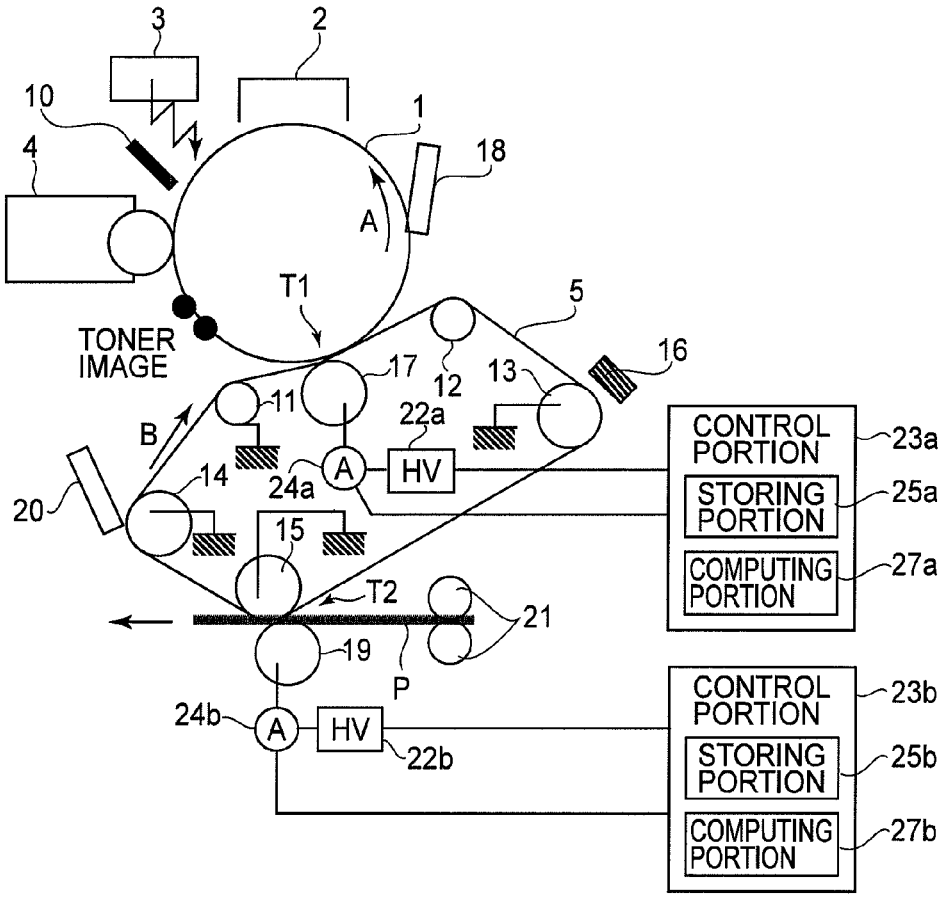
FIG. 7 is a schematic view according to Third Embodiment of the present invention.

Third Embodiment of the present invention will be described with reference to FIGS. 7 and 8. In this embodiment, in addition to the constitution of First Embodiment, the image forming apparatus includes computing portions 27*a* and 27*b* for deriving the relationship between the current value and the voltage value on the basis of a plurality of current values detected by the current detecting portions 24*a* and 24*b* and the voltage values applied at that time. The control portions 23*a* and 23*b* curve the power sources 22*a* and 22*b* so that different voltages are applied to the primary transfer roller 17 and the secondary transfer roller 19 at the intervals between adjacent toner images which are successively transferred onto the intermediary transfer belt 5 or the recording material P. Particularly, in this embodiment, on the basis of the voltage values applied at the intervals between adjacent toner images and of the current values, with respect to these voltage values, detected by the current detecting portions 24*a* and 24*b*, the relationship between the current value and the voltage value is derived by the computing portions 27*a* and 27*b*. From the derived relationship, the voltage value corresponding to the target current value is obtained. Then, when the toner image is transferred, the control portions 23*a* and 23*b* control the power sources 22*a* and 22*b* so as to apply the voltage value.

Figure 8:
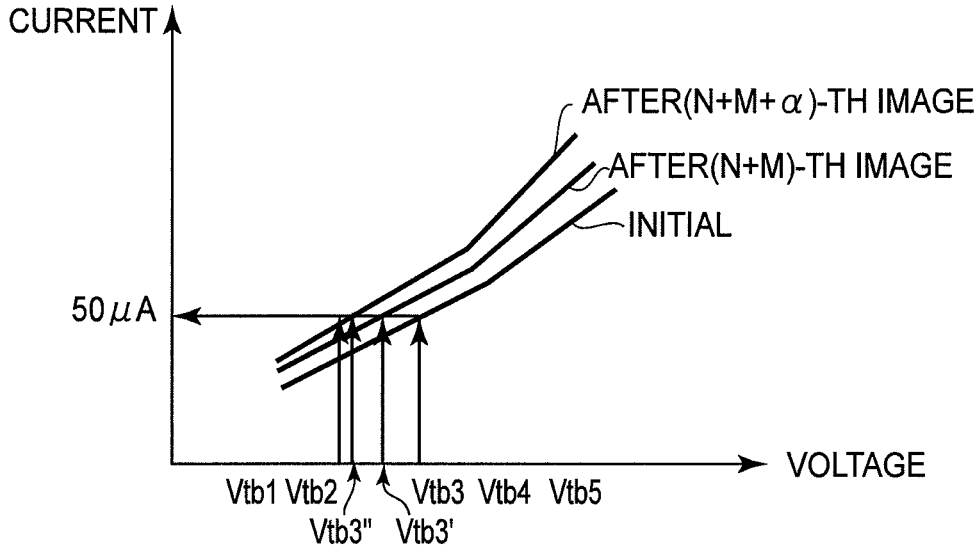
FIG. 8 is a graph showing relationships between the current and the voltage in the initial state, after formation of the (N+M)-th image, and after formation of an (N+M+$\alpha$)-th image in Third Embodiment.

That is, as shown in FIG. 8, in a similar manner as in the case where the I-V curve in the initial state is obtained from data including five voltage values Vtb1 to Vtb5 applied at the primary transfer portion T1 at the image intervals and including associated five current values, the I-V curve after formation of the (N+M)-th image is obtained. Next, from these relationships between the current and the voltage, the voltage value corresponding to the target current value is derived.

In the case where the derived voltage value (Vtb3' in this case) is different from the voltage value Vtb3 determined in the initial PTVC, the voltage applied to the primary transfer roller 17 is changed from Vtb3 to Vtb3'. Similarly, in the case where the voltage value (Vtb3" in this case), with respect to the target current value, obtained from data including subsequent five voltage values Vtb1 to Vtb5 and associated five current values is different from the voltage value Vtb3', the voltage value Vtb3" newly determined is applied to the primary transfer roller 17. Incidentally, at the secondary transfer portion T2, similar control is effected in consideration of the shared voltage Vp of the recording material P. In this embodiment, as described above, the relationship between the current and the voltage is obtained as needed and corresponding correction is made. By repeating such operations, it is possible to effect the control with high accuracy. Other constitution and actions are similar to those in the above-described First Embodiment.

Incidentally, in the above description in First to Third Embodiments, the constitution of the intermediary transfer type in which the single photosensitive drum and the intermediary transfer belt are used is employed but the present invention is applicable to any image forming apparatus in which the current passes through the transfer means during the transfer of the toner image. For example, an image forming apparatus of a recording material conveyance type in which the intermediary transfer belt is not provided and the recording material is directly conveyed to the transfer portion where the toner image is transferred from the photosensitive drum onto the recording material, and an image forming apparatus of a tandem type in which a plurality of photosensitive drums is arranged side by side.

As described above, even when the intervals between adjacent recording materials are small, it is possible to calculate the transfer voltage with high accuracy.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 189053/2009 filed Aug. 18, 2009, which is hereby incorporated by reference herein.

What is claimed is:

1. An image forming apparatus comprising:

a first image bearing member;

a transfer member for transferring a toner image from said first image bearing member onto a second image bearing member at a transfer portion;

a control portion for controlling a voltage to be applied to said transfer member; and a current detecting portion for detecting a value of a current passing through the transfer portion, wherein during execution of a continuous image forming mode in which images are continuously formed on the second image bearing member, said control portion applies a first voltage value to said transfer member at a first interval between images and applies a second voltage value different from the first voltage value at a second interval between images that is different from the first interval between images, and said control portion selects a transfer voltage value to be applied to said transfer member, the transfer voltage value being a voltage value, selected from the first voltage value and the second voltage value, at which a detected current value is closest to a target current value, and wherein the transfer voltage value is a voltage value when the toner image is transferred from said first image bearing member onto the second image bearing member.

2. An apparatus according to claim 1, wherein the first and second intervals between images are consecutive intervals between images.

3. An apparatus according to claim 1, wherein the first voltage value and the second voltage value are applied to said transfer member at the first and second intervals between images in a predetermined order.

4. An apparatus according to claim 1, wherein said first image bearing member comprises a photoconductive member and the second image bearing member comprises an intermediate transfer member.

5. An apparatus according to claim 1, wherein said control portion applies different voltage values to said transfer member at three or more intervals, respectively, each between images, and wherein said control portion selects a transfer voltage value to be applied to said transfer member, the transfer voltage value being a voltage value, selected from the different voltage values applied by said control portion, at which the detected current value is closest to the target current value.

6. An apparatus according to claim 1, wherein the target current value for the transfer voltage value to be applied to said transfer member is between a first current value and a second current value.

7. An apparatus according to claim 1, wherein said first image bearing member comprises an intermediate transfer member and the second image bearing member comprises a transfer sheet.

* * * * *